US008230940B2

(12) United States Patent
Winkes

(10) Patent No.: US 8,230,940 B2
(45) Date of Patent: Jul. 31, 2012

(54) METHOD FOR DRIVING A SUPPORT INTO A GROUND SURFACE BY MEANS OF A PILE-DRIVING DEVICE, AND A PILE-DRIVING DEVICE FOR USE WITH SUCH A METHOD

(75) Inventor: Jasper Stefan Winkes, Amsterdam (NL)

(73) Assignee: Technische Universiteit Eindhoven, Eindhoven (NL)

( * ) Notice: Subject to any disclaimer, the term of this patent is extended or adjusted under 35 U.S.C. 154(b) by 383 days.

(21) Appl. No.: 12/530,147

(22) PCT Filed: Mar. 6, 2008

(86) PCT No.: PCT/NL2008/000072

§ 371 (c)(1),
(2), (4) Date: Sep. 4, 2009

(87) PCT Pub. No.: WO2008/111833

PCT Pub. Date: Sep. 18, 2008

(65) Prior Publication Data

US 2010/0018733 A1 Jan. 28, 2010

(30) Foreign Application Priority Data

Mar. 9, 2007 (NL) ..... 1033529

(51) Int. Cl.
*B21J 7/26* (2006.01)
*E02D 7/12* (2006.01)

(52) U.S. Cl. ..... 173/1; 173/2; 173/91; 173/128; 173/133

(58) Field of Classification Search ..... 173/1, 2, 173/90, 91, 133, 138, 209, 29, 128, 201; 123/48 D, 292
See application file for complete search history.

(56) References Cited

U.S. PATENT DOCUMENTS

| | | | | |
|---|---|---|---|---|
| 2,093,634 | A * | 9/1937 | Cordes | 173/133 |
| 2,633,832 | A | 4/1953 | Spurlin | 123/7 |
| 3,303,892 | A * | 2/1967 | Nishimura et al. | 173/133 |

(Continued)

FOREIGN PATENT DOCUMENTS

| | | |
|---|---|---|
| BE | 414 189 | 4/1936 |
| BE | 496 238 | 10/1950 |
| CA | 2341680 | 3/2000 |
| DE | 198 38 838 | 3/2000 |
| GB | 656 493 | 8/1951 |
| GB | 825 323 | 12/1959 |
| GB | 1 319 213 | 6/1973 |

*Primary Examiner* — Scott A. Smith
(74) *Attorney, Agent, or Firm* — Roberts & Roberts, LLP

(57) ABSTRACT

A method and pile-driving device for driving a support into a ground surface. The device comprises a cylinder, an anvil which closes the lower side of the cylinder at least substantially, a ram which is movable as a piston above the anvil within the cylinder, and an injection device for injecting fuel into a combustion chamber between the anvil and the ram. The device has adjusting means for adjusting the moment of fuel injection and/or the amount of fuel to be injected. The method includes: causing the ram to move downward; injecting fuel into the combustion chamber; causing the fuel to combust for driving the ram upward, in such a manner that said combustion occurs before the ram strikes the anvil, wherein the moment of fuel injection and/or the amount of fuel to be injected is/are adjusted in dependence on at least one variable.

16 Claims, 2 Drawing Sheets

U.S. PATENT DOCUMENTS

| | | | | |
|---|---|---|---|---|
| 3,595,324 | A | 7/1971 | Guild et al. | 173/101 |
| 3,789,930 | A | 2/1974 | Nishimura et al. | 173/1 |
| 4,098,356 | A * | 7/1978 | Last | 173/131 |
| 4,109,475 | A | 8/1978 | Schnell | 61/53.5 |
| 4,497,376 | A * | 2/1985 | Kurylko | 173/1 |
| 4,860,835 | A * | 8/1989 | Mauch | 173/133 |
| 5,154,667 | A * | 10/1992 | Mauch et al. | 173/135 |
| 5,934,245 | A * | 8/1999 | Miller et al. | 123/296 |
| 7,156,188 | B2 * | 1/2007 | Bermingham et al. | 173/2 |
| 7,404,449 | B2 * | 7/2008 | Bermingham et al. | 173/2 |

* cited by examiner 2
6
1
4
9
7

2
6
1
10
9
7

2
6
1
5
8
9
12
10
11
17

3
2
6
1
4
9
7

METHOD FOR DRIVING A SUPPORT INTO A GROUND SURFACE BY MEANS OF A PILE-DRIVING DEVICE, AND A PILE-DRIVING DEVICE FOR USE WITH SUCH A METHOD

BACKGROUND OF THE INVENTION

The present invention relates to a method for driving a support into a ground surface by means of a pile-driving device comprising a cylinder, an anvil for transmitting a striking motion to the support, which anvil closes the lower side of the cylinder at least substantially, a ram which is capable of reciprocating movement as a piston above the anvil within the cylinder, and an injection device for injecting fuel under pressure into a combustion chamber defined by the cylinder wall, the anvil and the ram, comprising the steps of:

a) causing the ram to move downward, b) injecting fuel into the combustion chamber, c) causing the fuel to combust so as to generate an elevated pressure in the combustion chamber for driving the ram upward as a result of said elevated pressure after the ram has struck the anvil. Causing the fuel to combust suggests that concrete action is taken to effect combustion of the fuel. This need not be the case, however. With such a device, combustion of the fuel generally takes place by auto-ignition in the combustion space caused by the pressure in the combustion chamber and the temperature of a gas mixture that is present in the combustion chamber. The word "cause" used in this context relates to the timing of the moment at which the combustion takes place. This depends, among other factors, on the moment of injection of the fuel, the pressure in the combustion chamber and the composition and temperature of the gas mixture present in the combustion chamber, which both increase as a result of the downward movement of the ram. The moment of injection is initiated by a detector, which detects when the ram passes a specific point during its downward movement. The values of the three latter variables during a cycle are not constant, however. This means that the moment of combustion of the fuel in relation to the position of the falling ram varies in dependence on the variables during the pile driving operation.

FIELD OF THE INVENTION

A method as referred to in the introduction is known. In the known method, the moment of injection of the fuel is selected so that the fuel will combust after the ram has struck the anvil, preferably at the moment when the ram "jumps up" in reaction to striking the anvil. An enormous pressure increase caused by the combustion in the combustion chamber drives the ram upward, thereby converting said pressure into potential energy of the ram. During its upward movement the ram passes an opening in the wall of the cylinder and the exhaust gases from the combustion chamber exit through the opening. As a result, an underpressure is generated in the space within the cylinder that is defined by the anvil and the rising ram. As a result of said underpressure, fresh air for a next combustion cycle is sucked into the space through the opening in the cylinder wall during the upward movement of the ram, after the ram has passed the opening in the cylinder wall. After the upward movement of the ram has decelerated due to the force of gravity and friction and, depending on the type of file-driving device, any other forces has come to a standstill, the ram will move downward again as a result of the force of gravity and, depending on the type of pile-driving device, any other forces, at which point the potential energy is converted into kinetic energy until the ram strikes the anvil. During said movement, the ram passes the opening in the cylinder wall again, as a result of which the space between the anvil and the ram within the cylinder is closed again and a substantially airtight combustion chamber is formed. When the ram moves further downward, the air in the combustion chamber can no longer escape and the gas mixture present in the closed combustion chamber is compressed so as to generate a pressure that is needed for the auto-ignition of the fuel. When the ram strikes the anvil, the kinetic energy of the ram is used for driving the support into the ground. This cycle is repeated until the support has been driven sufficiently far into the ground.

A drawback of the known pile-driving device is the fact that its control range is limited to about 30-100% impact energy. This is caused by the fact that a minimum jump height of the ram is required for the intake of fresh air through the opening in the wall of the cylinder into the space defined by the anvil and the ram for the combustion of fuel during the next cycle. Add to this the fact that the opening must be spaced from the anvil by at least a specific distance in order to be able to generate the auto-ignition by means of the ram. The potential energy of the ram at said minimum jump height is converted into kinetic energy again, as a result of which also the kinetic energy of the ram just before the ram strikes the anvil has a minimum value. Said minimum value determines the lower limit of the control range. In view of the lower limit of the impact force with which the ram strikes the anvil, such a pile-driving device is less suitable for use in the case of soft ground layers, easily damaged supports and/or sensitive pile-driving operations.

Consequently it is an object of the present invention to provide a method as referred to in the introduction which makes it possible to regulate or control the impact force such that regulation or control will also be possible in a range lower than 30% of the impact energy capacity of the pile-driving device. This object is accomplished by the present invention in that step c) is carried out in such a manner that combustion takes place before the ram strikes the anvil. As a result, the ram is decelerated during the last part of its downward movement by the elevated pressure in the combustion chamber caused by the early combustion (in comparison with the known method), which pressure further increases as a result of compression in the combustion chamber and which adds to the deceleration effect. Whereas the ram makes a free fall in the method according to the introduction after having passed the opening in the cylinder wall, and is decelerated only to a very limited degree and undesirably by the compression of the air that is present or the gas mixture to be combusted after the ram has struck the anvil, thus reducing the impact force of the ram, which is found to be a disadvantage of the prior art method, a resistance is intentionally built up in the method according to the introduction as a result of the pressure increase for intentionally decelerating the fall of the ram. During said deceleration of the ram, the air in the combustion chamber is further compressed, as a result of which the elevated pressure in the combustion chamber increases even further. When the ram finally strikes the anvil, the elevated pressure will drive the ram upward yet.

Although there exist hydraulic and pneumatic pile-driving devices that can be set so that the ram will strike the anvil with a minimal impact force, such pile-driving devices are more expensive than comparable combustion-type pile-driving devices.

SUMMARY OF THE INVENTION

In a preferred embodiment of the present invention, the moment of injection of the fuel and/or the amount of fuel to be injected is adjusted in dependence on at least one variable. In prior art pile-driving devices the moment of injection is determined by the moment at which a sensor or detector detects that the ram passes a specific position. Said moment may vary, to be true, but this must not be considered to be a variable in the sense of the variable that is meant in the present document, because the position in question is unchangeably fixed for a particular pile-driving device and the moment of injection is an unchangeable constant from the moment the detection takes place. The term "variable" as used in this document means that the timing of the injection can be actively set or adjusted in dependence on the measured value of the variable. Thus, the moment of combustion can be actively adjusted in dependence on the measured value(s) of the variable(s).

In a preferred embodiment of the present invention, the impact velocity at which the ram strikes the anvil is measured for the purpose of adjusting the moment of fuel injection and/or the amount of fuel to be injected for a next cycle. If the measured impact velocity is different from the desired impact velocity, the moment of fuel injection and/or the amount of fuel to be injected can be set or adjusted for influencing the impact velocity for a next cycle.

It is preferable to measure the temperature of the gas in the combustion chamber for the purpose of adjusting the moment of fuel injection and/or the amount of fuel to be injected. Since the temperature of the gas influences the moment of auto-ignition of the fuel, the desired injection moment can be determined more adequately on the basis of the temperature value that is thus known.

It is furthermore preferable to measure the pressure in the combustion chamber for the purpose of adjusting the moment of fuel injection and/or the amount of fuel to be injected. Since the pressure in the combustion chamber influences the moment of auto-ignition of the fuel, the desired injection moment can be determined more adequately on the basis of the pressure value that is thus known.

According to a second aspect of the present invention, the invention relates to a pile-driving device for driving a support into a ground surface, comprising a cylinder, an anvil for transmitting a striking motion to the support, which anvil closes the lower side of the cylinder at least substantially, a ram which is capable of reciprocating movement as a piston above the anvil in the cylinder for transmitting kinetic energy from the ram to the anvil, an injection device for injecting fuel under pressure into a combustion chamber defined by the cylinder wall, the anvil and the ram for driving the ram upward in the cylinder as a result of the combustion of the fuel, and a position detector for activating the injection device in dependence on the position of the ram.

Such devices are generally used as pile-driving devices. The position detector is so arranged that it detects the moment when the ram passes a predetermined point within the cylinder during its fall, as a consequence of which the injection of fuel by the injection device is initiated. The moment of fuel injection is thus fixed, viz. the moment when the ram passes said specific point plus a possible (constant) delay.

A drawback of the known pile-driving device, however, is the fact that a number of variables influence the moment of combustion of the fuel in the combustion chamber. The change in the values of some of said variables during a cycle of the pile-driving device may moreover vary from cycle to cycle. Said specific point must therefore be selected so that combustion will take place at an acceptable moment in (substantially) all possible conditions. Also external conditions, such as the outside temperature and the composition of the (ambient) air to be supplied to the combustion chamber and the quality of the fuel to be injected, for example the centane number, are variables whose value influences the moment of combustion.

According to a second aspect of the present invention, the object of the invention is to provide a pile-driving device wherein it is possible to optimise the combustion of the fuel during the pile driving operation. This object is accomplished by the present invention in that the pile-driving device comprises adjusting means for adjusting the moment of fuel injection and/or the amount of fuel to be injected. Adjusting the moment of fuel injection makes it possible to determine the moment of combustion better and in dependence on the prevailing conditions than in the situation in which the moment of fuel injection is determined by the device, as it were. Adjusting the amount of fuel makes it possible to adjust the degree of combustion, making it possible to control the degree to which the ram is driven upward and, at least if combustion takes place before the ram strikes the anvil, the deceleration of the ram during its downward movement better and in dependence on the prevailing conditions than with the prior art pile-driving device. A pile-driving device according to the present invention thus provides a possibility of adjusting the moment of fuel injection and/or the amount of fuel to be injected in dependence on conditions which may be detected by a sensor or a detector, for example, and which may for example be passed on in the form of measured values of specific variables that influence the combustion process. This aspect may also be used separately from the first aspect of the invention for optimising the moment of combustion for driving the ram upward, without the combustion of the fuel contributing to the deceleration of the fall of the ram before it strikes the anvil.

In a preferred embodiment of the present invention, the pile-driving device comprises a velocity sensor for measuring the impact velocity at which the ram strikes the anvil for the purpose of adjusting the moment of fuel injection and/or the amount of fuel to be injected for a next cycle, using adjusting means. The moment of fuel injection and/or the amount of fuel to be injected for a next cycle can thus be adjusted in that a signal is sent from the velocity sensor to a control or regulating device, which control or regulating device controls or regulates the desired setting.

In a preferred embodiment of the present invention, the pile-driving device comprises a temperature sensor for measuring the temperature of the gas in the combustion chamber for the purpose of adjusting the moment of fuel injection and/or the amount of fuel to be injected for a next cycle in dependence on the measured temperature, using adjusting means. The moment of fuel injection and/or the amount of fuel to be injected for a next cycle can thus be adjusted in that a signal is sent from the temperature sensor to a control or regulating device, which control or regulating device controls or regulates the desired setting.

In a preferred embodiment of the present invention, the pile-driving device comprises a pressure sensor for measuring the pressure in the combustion chamber for the purpose of adjusting the moment of fuel injection and/or the amount of fuel to be injected for a next cycle in dependence on the measured pressure, using adjusting means. The moment of fuel injection and/or the amount of fuel to be injected for a next cycle can thus be adjusted in that a signal is sent from the pressure sensor to a control or regulating device, which control or regulating device controls or regulates the desired setting.

The present invention will now be explained in more detail with reference to an embodiment of a pile-driving device according to the present invention, which is only shown by way of example in the appended drawings, in which:

DETAILED DESCRIPTION OF THE INVENTION

Figure 1:
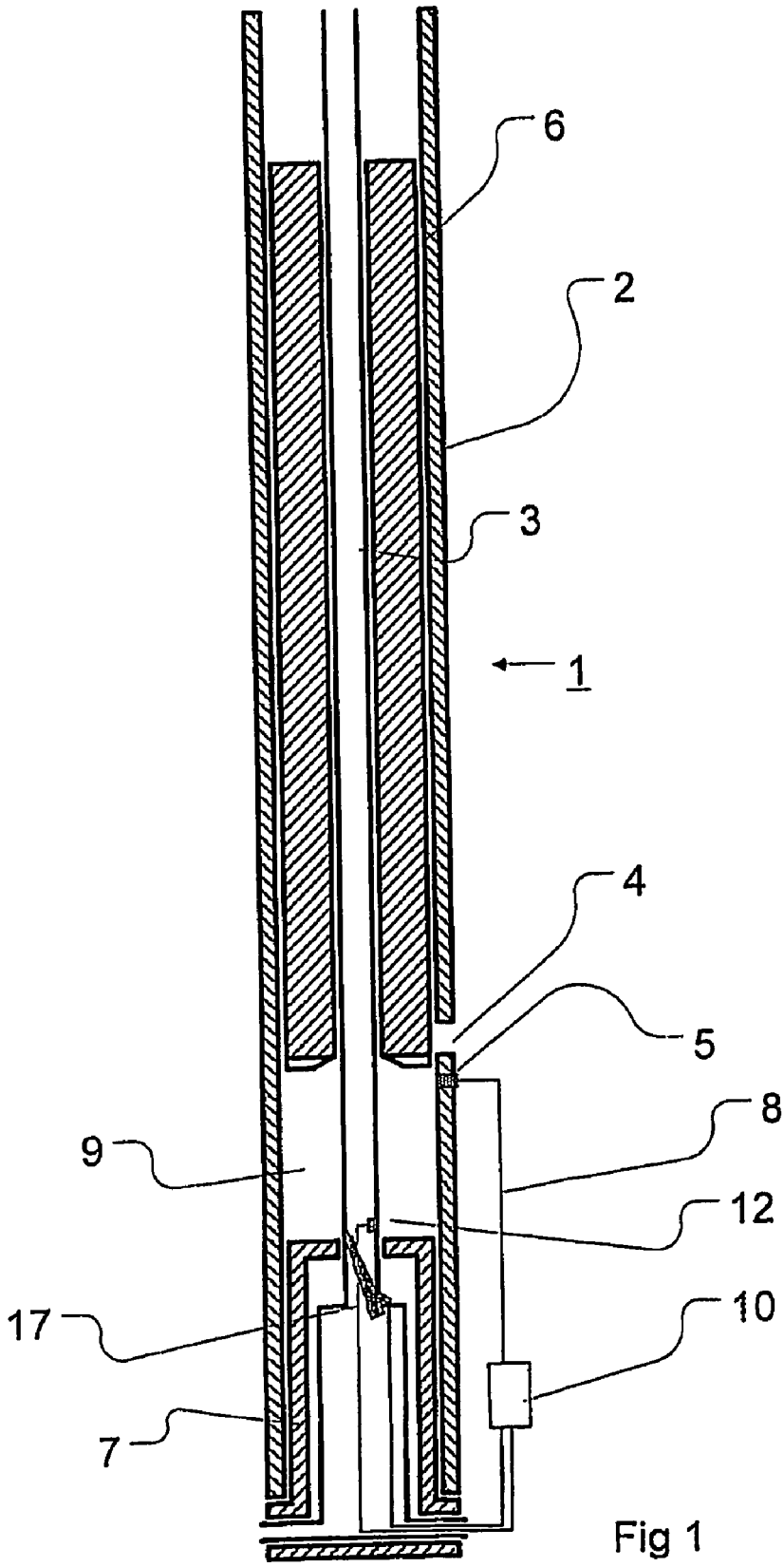
FIG. 1 is a sectional view of a pile-driving device according to the present invention.

FIG. 1 shows a longitudinal sectional view of a pile-driving device 1 according to the present invention, comprising a cylinder 2 within which a ram 6 is movably accommodated. The cylinder 2 encloses an anvil 7 at its lower end. In the lower part of the cylinder 2, the ram 6 and the anvil 7 define a combustion chamber 9. An opening 4 is present in the side wall of the cylinder 2. An injection device 17 is provided in the combustion chamber 9 for injecting fuel into the combustion chamber at 9 under pressure. A pipe 3 extends within the cylinder 2, around which pipe the ram 6 can move within the cylinder 2. A detection 5 is provided in the side wall of the cylinder 2, which detection device is connected to a control unit 10 via a communication channel 8 for controlling the injection device 17. A sensor 12 is disposed near the injection device for measuring the temperature and the pressure in the combustion chamber 9.

Figures 2A, 2B, 2C, 2D:
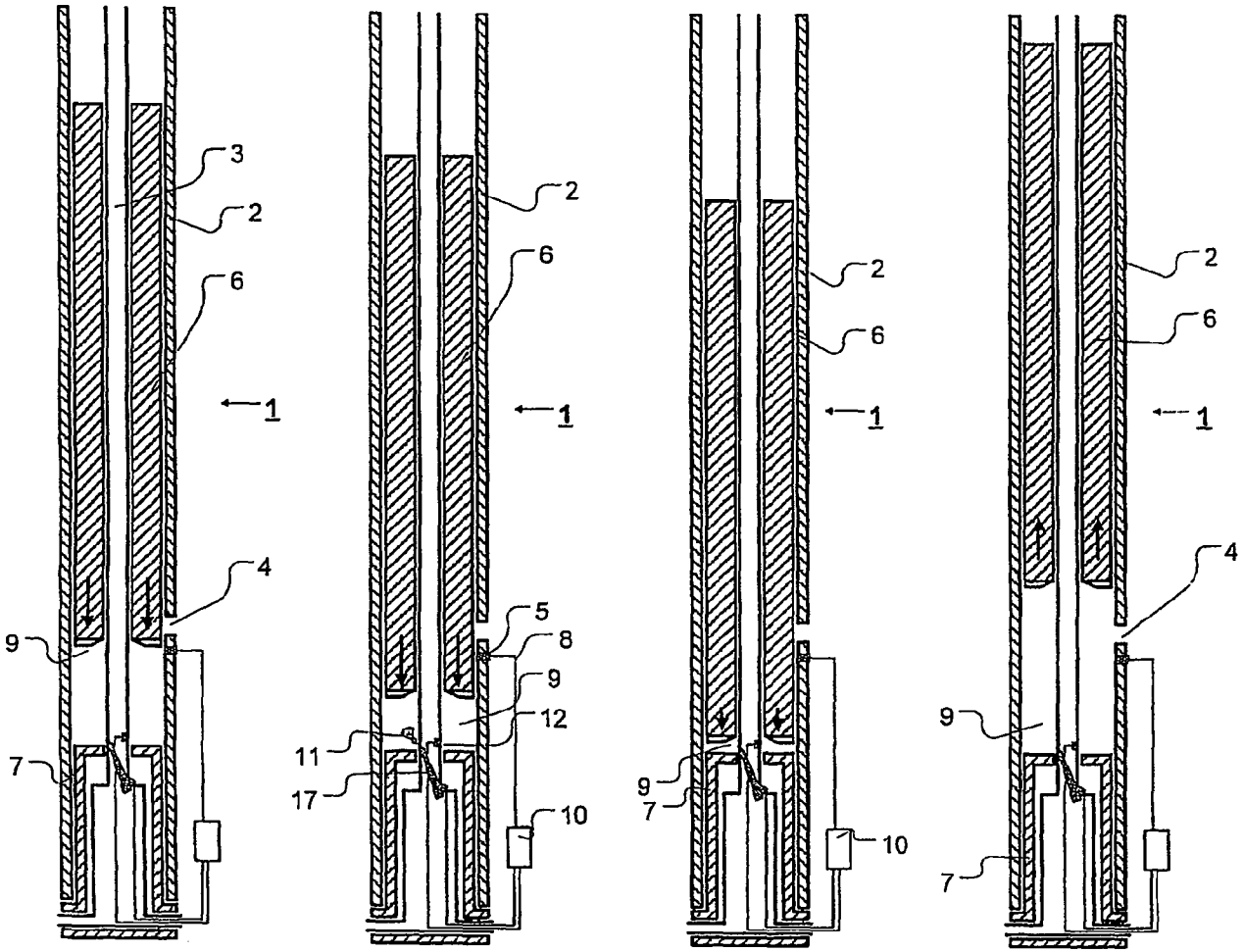
FIGS. 2*a*-2*d* show various situations during a pile-driving cycle of the pile-driving device of FIG. 1.

FIG. 2 shows four situations (FIGS. 2*a*, 2*b*, 2*c* and 2*d*, respectively) of the pile-driving device 1 of FIG. 1 during successive stages of a pile-driving cycle. In FIG. 2*a* the ram 6 moves downward around the pipe 3 within the cylinder 2, in the direction of the anvil 7. FIG. 2*b* shows a next stage, in which the ram 6 has moved further downward in the cylinder 2. The ram 6 has passed the detection device 5 and the injection device 17 injects diesel fuel 11 into the combustion chamber 9 under pressure. Shortly afterward the pile-driving device 1 is in the situation as shown in FIG. 2*c*, and the diesel fuel in the combustion chamber 9 and the air present in the combustion chamber 9 have combusted. FIG. 2*d*, to conclude, shows the situation in which the ram 6 has been driven upward, past the opening 4 in the wall of the cylinder 2, as a result of the enormous increase in the air pressure in the combustion chamber 9 caused by the combustion of diesel fuel and air (see FIG. 2*c*).

The operation of the pile-driving device 1 according to the present invention will now be explained in more detail with reference to the appended figures. Starting with FIG. 2*a*, the ram 6 falls in the direction of the anvil 7. The ram 6 has just passed the opening 4, as a result of which the wall of the cylinder 2, the anvil 7 and the ram 6 now define a closed combustion chamber 9. The air in the combustion chamber 9 is compressed by the downward movement of the ram 6, the side-effect being a temperature increase in the combustion chamber 9.

During its downward movement from the situation shown in FIG. 2*a*, the ram 6 passes the detection device 5, which detects the position and measures the velocity of the ram 6. The detections of the detection device 5 and of the sensor 12 are sent to the control unit 10 via the communication channel 8. The control unit 10 determines the moment at which the injection device 7 injects diesel fuel 11 into the combustion chamber 9 under pressure in dependence on the value of the variables and an algorithm. FIG. 2*b* shows the situation in which this is just happening.

The ram 6 moves further downward within the cylinder 2 (see FIG. 2*c*), as a result of which the pressure and the temperature in the combustion chamber 9 further increase and auto-ignition of the mixture of air and atomised diesel fuel present in the combustion chamber 9 takes place. As a result of said auto-ignition and the combustion of the mixture in the combustion chamber 9, the pressure in the combustion chamber increases enormously, as a result of which the downward movement of the ram 6 is decelerated. As a result of this the ram 6 will strike the anvil 7 less hard than in the situation in which the combustion of the diesel-air mixture would only take place after the ram has struck the anvil, as is the case with methods and pile-driving devices according to the prior art. The moment of injection of diesel fuel can be adjusted via the control unit 10, so that the combustion can be determined in dependence on the prevailing conditions and the requirements. Combustion will take place between the moment the ram 6 is in the position shown in FIG. 2*b* and a moment just after the ram 6 has struck the anvil. In addition to possibly decelerating the ram 6 during the last part of its downward movement, the enormous pressure increase in the combustion chamber 9 causes the ram 6 to be driven upward within the cylinder 2 for building up the potential energy required in order to enable the ram 6 to strike the anvil 7 in the next cycle. The ram 6 moves past the opening 4 in the wall of the cylinder 2 (see FIG. 2*d*), and as a result of the overpressure in the combustion chamber 9, combustion gases can flow out through the opening. Upon further upward movement of the ram 6 (and as a result of the overpressure being released via the opening 4), an underpressure is generated in the combustion chamber 9 and fresh air is sucked into the combustion chamber 9 from outside. Said fresh air is needed for the combustion of diesel fuel in the next cycle. Eventually the ram 6 will come to a standstill in the cylinder 2 and subsequently move downwards again, successively reaching the situations shown in FIGS. 2*a*, 2*b* and 2*c* again.

The moment of ignition of the diesel-air mixture in the combustion chamber can be varied by adjusting the control unit 10. The control unit is adjusted so that the desired moment of injection by the injection device 17 can be determined in dependence on the measurements by the detection device 5 and the sensor 12. An operator of the pile-driving device 1, for example, or a programmer of the control unit 10 will first determine the desired moment of ignition of the air-diesel mixture in the combustion chamber 9 and subsequently he will determine the moment at which the diesel is to be injected at different values of specific variables as measured by the detection device 5 and the sensor 12 and passed on to the control unit 10. It is also possible to vary the moment of injection of diesel fuel during the pile-driving process in dependence on the condition of the ground layers through which a pile to be driven into the ground with the pile-driving device passes. In this regard it is for example possible to make use of a measurement of the distance over which the pile (not shown) is driven into the ground as a result of the impact of the ram 6 on the anvil 7.

In the foregoing only one embodiment of a pile-driving device according to the present invention and only one method according to the present invention for using a pile-driving device have been described by way of example. These examples do not have any limitative effect on the scope of the present invention, however, which is determined by the appended claims. Several variations will be obvious to those skilled in the art, which variations all fall within the scope of protection of the present invention. Thus it is possible, for example, to have the ignition of the diesel-air mixture in the combustion chamber take place after the ram has struck the anvil, so that the downward movement of the ram for striking the anvil 7 is not decelerated. Furthermore it is possible to use a cylinder having a closed upper end, in which case the combustion chamber may be formed in the space between the ram and the upper end of the cylinder for combusting fuel for the purpose of driving the ram downward at an accelerated rate. It is also possible to form openings in the pipe around which the ram extends for supplying fresh air or discharging the exhaust gas to or from, respectively, the combustion chamber 9. In that case it would not be necessary to provide an opening in the wall of the cylinder for this purpose. In addition to the aforesaid detection means, other detectors and/or sensors may be used, which send signals to the control unit for effecting an even better control of the moment of combustion. Furthermore, a pile-driving device as described herein for driving a pile into the ground may also be used for the other operations, for example breaking ground, for example rocky bottom, or for compacting soil.

The invention claimed is:

1. A method for driving a support into a ground surface by means of a pile-driving device comprising a cylinder, an anvil for transmitting a striking motion to the support, which anvil closes a lower side of the cylinder at least substantially, a ram which is capable of reciprocating movement as a piston above the anvil within the cylinder, and an injection device for injecting fuel under pressure into a combustion chamber defined by the cylinder wall, the anvil and the ram, comprising the steps of:

a) causing the ram to move downward, b) injecting fuel into the combustion chamber, c) causing the fuel to combust so as to generate an elevated pressure in the combustion chamber for driving the ram upward as a result of said elevated pressure after the ram has struck the anvil, in such a manner that said combustion occurs before the ram strikes the anvil, wherein the moment of fuel injection and/or the amount of fuel to be injected is/are adjusted in dependence on at least one variable.

2. The method according to claim 1, wherein an impact velocity at which the ram strikes the anvil is measured for the purpose of adjusting the moment of fuel injection and/or the amount of fuel to be injected for a next cycle.

3. The method according to claim 2 wherein the temperature of gas in the combustion chamber is measured for the purpose of adjusting the moment of fuel injection and/or the amount of fuel to be injected.

4. The method according to claim 3 wherein the pressure in the combustion chamber is measured for the purpose of adjusting the moment of fuel injection and/or the amount of fuel to be injected.

5. The method according to claim 2 wherein the pressure in the combustion chamber is measured for the purpose of adjusting the moment of fuel injection and/or the amount of fuel to be injected.

6. The method according to claim 1 wherein the temperature of gas in the combustion chamber is measured for the purpose of adjusting the moment of fuel injection and/or the amount of fuel to be injected.

7. The method according to claim 6 wherein the pressure in the combustion chamber is measured for the purpose of adjusting the moment of fuel injection and/or the amount of fuel to be injected.

8. The method according to claim 1 wherein the pressure in the combustion chamber is measured for the purpose of adjusting the moment of fuel injection and/or the amount of fuel to be injected.

9. A pile-driving device for driving a support into a ground surface, comprising a cylinder, an anvil for transmitting a striking motion to the support, which anvil closes a lower side of the cylinder at least substantially, a ram which is capable of reciprocating movement as a piston above the anvil in the cylinder for transmitting kinetic energy from the ram to the anvil, an injection device for injecting fuel under pressure into a combustion chamber defined by the cylinder wall, the anvil and the ram for driving the ram upward in the cylinder as a result of the combustion of the fuel, and a position detector for activating the injection device in dependence on the position of the ram, wherein the pile-driving device is provided with adjusting means for adjusting the moment of fuel injection and/or the amount of fuel to be injected.

10. The pile-driving device according to claim 9, wherein the pile-driving device comprises a velocity sensor for measuring the impact velocity at which the ram strikes the anvil for the purpose of adjusting the moment of fuel injection and/or the amount of fuel to be injected for a next cycle, using adjusting means.

11. The pile-driving device according to claim 10, wherein the pile-driving device comprises a temperature sensor for measuring the temperature of gas in the combustion chamber for the purpose of adjusting the moment of fuel injection and/or the amount of fuel to be injected in dependence on the measured temperature, using adjusting means.

12. A pile-driving device according to claim 11 wherein the pile-driving device comprises a pressure sensor for measuring the pressure in the combustion chamber for the purpose of adjusting the moment of fuel injection and/or the amount of fuel to be injected in dependence on the measured pressure, using adjusting means.

13. A pile-driving device according to claim 10 wherein the pile-driving device comprises a pressure sensor for measuring the pressure in the combustion chamber for the purpose of adjusting the moment of fuel injection and/or the amount of fuel to be injected in dependence on the measured pressure, using adjusting means.

14. The pile-driving device according to claim 9, wherein the pile-driving device comprises a temperature sensor for measuring the temperature of gas in the combustion chamber for the purpose of adjusting the moment of fuel injection and/or the amount of fuel to be injected in dependence on the measured temperature, using adjusting means.

15. A pile-driving device according to claim 14 wherein the pile-driving device comprises a pressure sensor for measuring the pressure in the combustion chamber for the purpose of adjusting the moment of fuel injection and/or the amount of fuel to be injected in dependence on the measured pressure, using adjusting means.

16. A pile-driving device according to claim 9 wherein the pile-driving device comprises a pressure sensor for measuring the pressure in the combustion chamber for the purpose of adjusting the moment of fuel injection and/or the amount of fuel to be injected in dependence on the measured pressure, using adjusting means.

* * * * *